US005191997A

United States Patent [19]

Squitieri

[11] Patent Number: 5,191,997

[45] Date of Patent: Mar. 9, 1993

[54] CAROUSEL-TYPE GRAVITY FEED FILM DISPENSER AND FILM CASSETTE THEREFOR

[75] Inventor: Anthony C. Squitieri, Norwalk, Conn.

[73] Assignee: Mechtronics Corporation, Stamford, Conn.

[21] Appl. No.: 892,970

[22] Filed: Jun. 3, 1992

[51] Int. Cl.[5] ..... A47F 1/00

[52] U.S. Cl. ..... 221/119; 221/281; 221/282; 221/303; 312/45; 312/135; 312/97.1

[58] Field of Search ..... 221/119, 120, 131, 132, 221/197, 281, 282, 287, 303, 312 R; 312/42, 45, 124, 125, 97.1, 135, 234.1, 350

[56] References Cited

U.S. PATENT DOCUMENTS

| | | | |
|---|---|---|---|
| 1,087,235 | 2/1914 | Hooper | 312/135 |
| 1,189,456 | 7/1916 | King | 312/97.1 |
| 3,399,781 | 9/1968 | Nalbandian | 312/135 |
| 3,661,268 | 5/1972 | Boley | 312/42 |
| 3,674,175 | 7/1972 | Jaquish | 221/92 |
| 3,733,112 | 5/1973 | Marquardt | 312/97.1 |
| 3,744,866 | 7/1973 | Cook | 312/42 |
| 5,000,344 | 3/1991 | Janssen | 221/131 |

FOREIGN PATENT DOCUMENTS

| | | | |
|---|---|---|---|
| 329838 | 9/1935 | Italy | 312/42 |

*Primary Examiner*—H. Grant Skaggs
*Attorney, Agent, or Firm*—Haynes N. Johnson

[57] ABSTRACT

A carousel for dispensing canisters of film having a film-holding base secured to a vertical spine mounted centrally of the base, a plurality of vertical dividers extending radially from, and circumferentially of, the spine, vertically-extending wall sections secured to the outermost edges of the dividers, so that the spine, the dividers, and the wall sections together form vertical channels to receive and hold the canisters. The uppermost portions of the wall sections are open to receive the canisters, and the lowermost ends of the wall sections are spaced from the base sufficiently to permit removal of individual canisters, and the base and with the upper end of the spine are pivoted where they are to be attached to a display device so the entire unit can be rotated. If desired, the canisters can have keys on their bodies or their caps, and the channels can have corresponding key slots, so that the canisters will be held in the channels with their labels outermost.

7 Claims, 4 Drawing Sheets

Fig. 6.
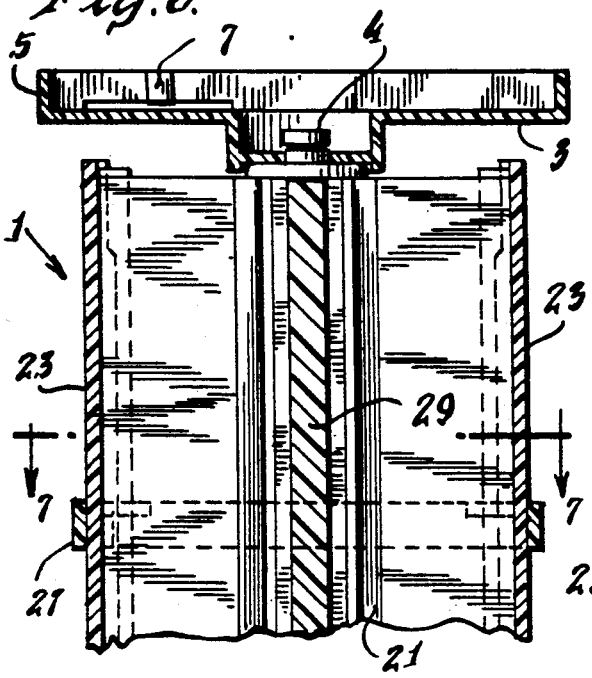
Fig. 7.
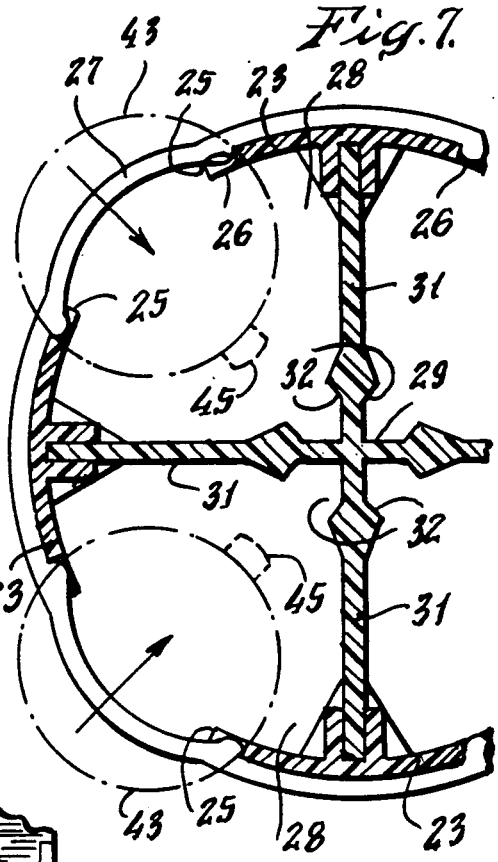
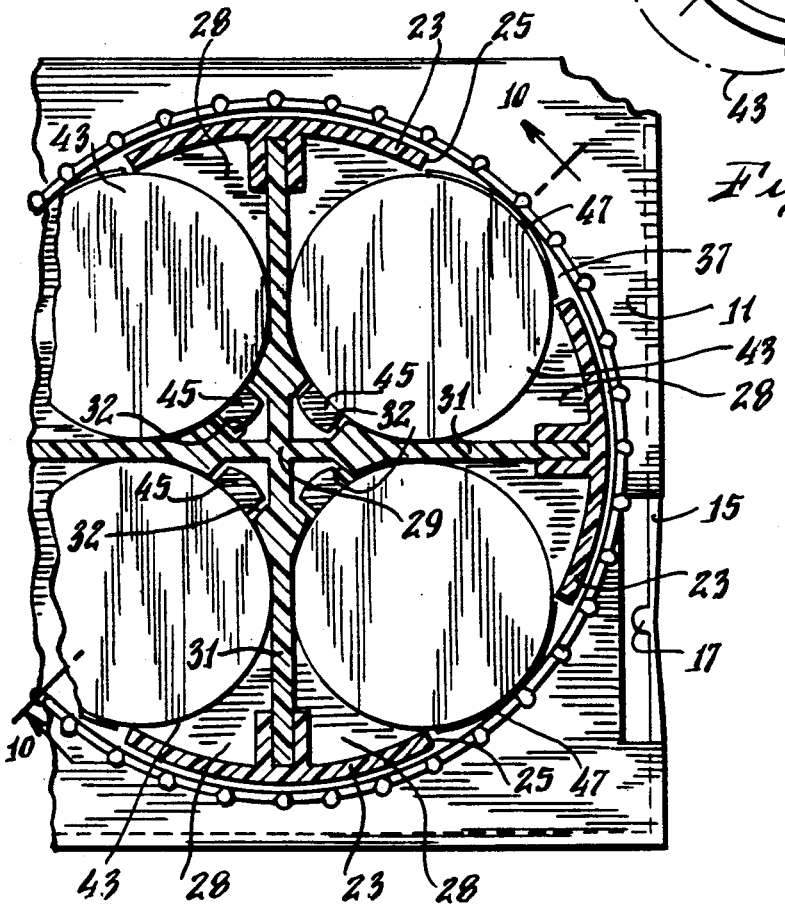
Fig. 9.
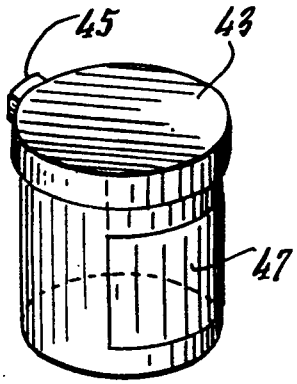
Fig. 8.

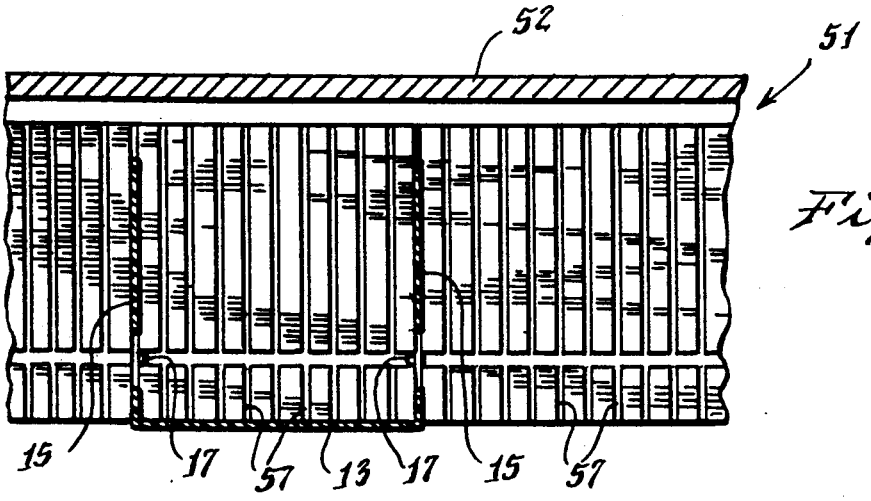
Fig. 14
Fig. 15
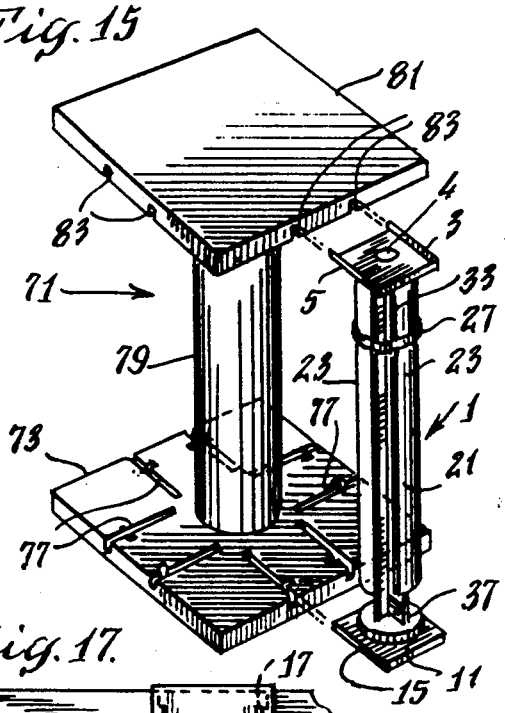
Fig. 16.
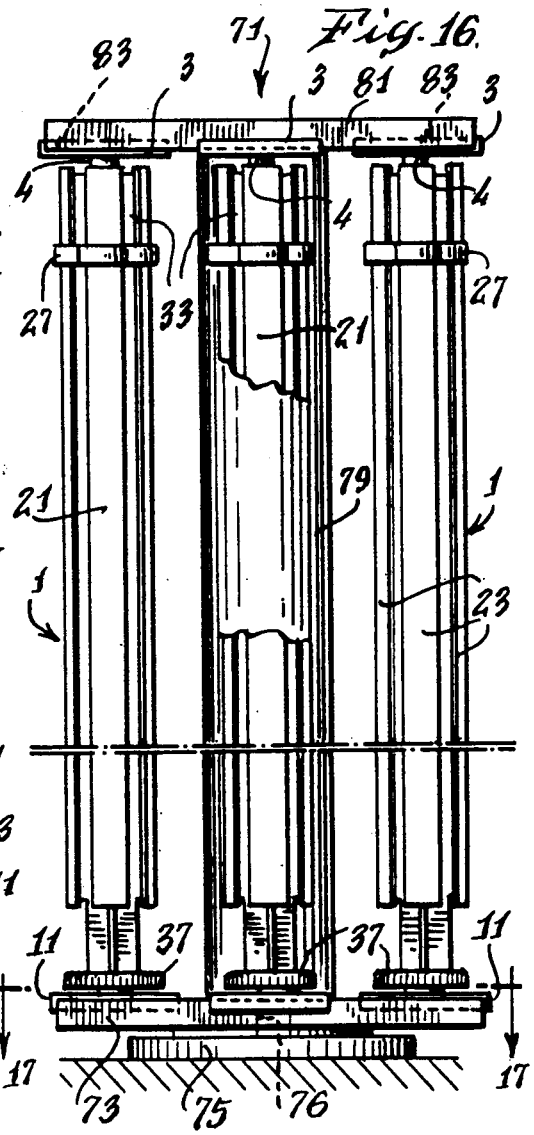
Fig. 17.
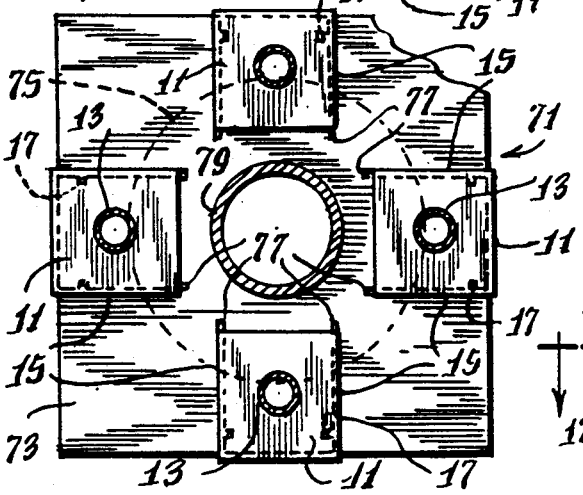

CAROUSEL-TYPE GRAVITY FEED FILM DISPENSER AND FILM CASSETTE THEREFOR

FIELD OF THE INVENTION

This invention relates to the field of film dispensers of the type used in retail stores to readily dispense a variety of sizes and types of film.

BACKGROUND OF THE INVENTION

Various forms of gravity-feed film dispensers have been used in the past. One, shown in Jaquish U.S. Pat. No. 3,674,175, is a free-standing display cabinet. This display cabinet measures about two feet wide, two feet tall, and five inches deep, and has vertical dividers which can be placed in different positions to form compartments for holding stacks of different size films. It has a transparent facing to display the film, and the facing is open along the bottom edge for film removal. The dividers fit within longitudinal grooves running from side to side on the inside surfaces of the top and bottom of the display.

An improvement on this Jaquish design has been used in which the display cabinet has alternating ribs and grooves running from front to back on the top and bottom, instead of from side to side. This permits the dividers to be more readily removed for adjustment. This unit also has a openings in the ribs to receive detents carried by the dividers, to better hold the dividers in place.

BRIEF SUMMARY OF THE INVENTION

My invention is a rotatable gravity-feed film dispenser, a carousel, which can be used in association with the foregoing types of display cabinet, especially the latter one, or as a separate free-standing unit. It is used primarily for dispensing smaller rolls of film, such as 35 mm film, packaged in cylindrical canisters, not boxes.

My dispenser is designed as a carousel having four vertical channels about a central spine, the carousel being pivotally mounted to top and bottom plates for rotation. The channels have openings at the top and bottom of their faces for receiving and dispensing film, and the fronts of the channels are slotted for their length so as to permit a clerk or customer to see which type of film is in each channel.

The film is packaged in individual cylindrical canisters which are sized to fit within the channels. Each channel has a longitudinal key slot in the back of the channel (along the spine) which receives a key on the canisters. This serves to keep the canisters so aligned that their labels can be seen through the slots in the front of the channels.

The carousel and its top and bottom plates are dimensioned to fit into a display cabinet, especially such as the second type of prior art cabinet described above, using a portion of the space which would have been used as compartments for boxes of film. Thus, the top and bottom plates would be square with each side having a length the same as or slightly less than the inside depth dimension of the display case. The bottom plate has downwardly extending flanges along its front to back edges to fit within alternating ribs and grooves running from front to back, and those flanges carry detents to interlock with the receiving openings in the ribs to lock the unit in place. The length of the carousel is such that similar upwardly extending flanges and detents on the top plate will fit within and lock to the top ribs and grooves.

The carousel can then be loaded with film canisters, with the labels showing through the slots, can be rotated so that the film in each of the channels can be brought to the front and dispensed from the bottom. At the same time other parts of the display case can be used with dividers to form compartments for boxed film.

In a modification of this invention, a free-standing turntable is used as a pivoted carrier for several of the four-channel carousels, permitting them to be used without a separate display case. The turntable has slots to receive the base plate flanges and interlock with their detents.

DESCRIPTION OF THE DRAWINGS

FIG. 6 is a vertical section taken on line 6—6 of FIG. 3.

FIG. 7 is a horizontal section taken on line 7—7 of FIG. 6.

FIG. 8 is a perspective view of a film canister of the type usable in the carousel.

FIG. 9 is a horizontal section taken on line 9—9 of FIG. 3, but also showing film canisters in place.

FIG. 14 is a vertical section taken on line 14—14 of FIG. 12.

FIG. 15 is a perspective view of a free-standing turntable having a single carousel in exploded position relative to it.

FIG. 16 is a vertical section taken on line 16—16 of FIG. 15.

FIG. 17 is a horizontal section taken on line 17—17 of FIG. 16.

DETAILED DESCRIPTION OF THE INVENTION

Figure 1:
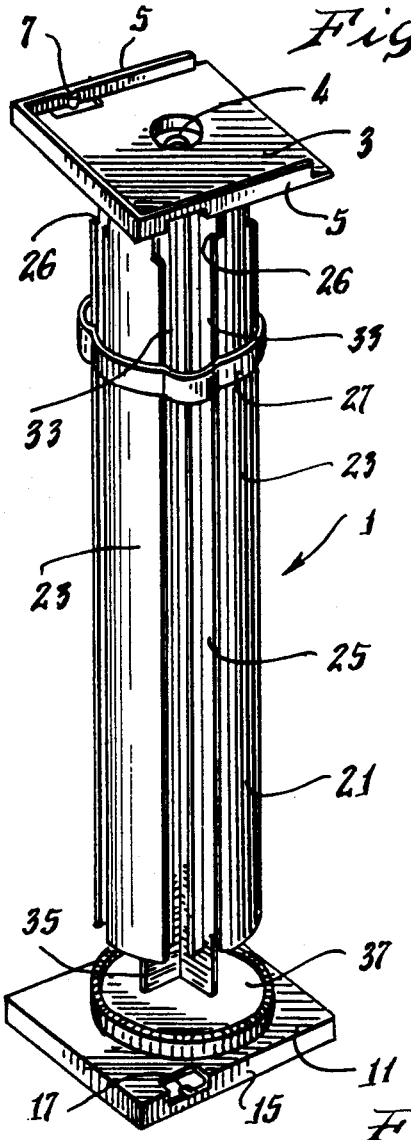
FIG. 1 is a perspective view of the carousel film dispenser of my invention. It is shown separately from a display cabinet or a turntable.
Figure 2:
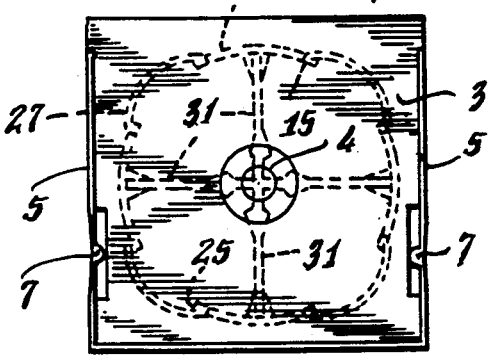
FIG. 2 is a top plan view of the top plate of the carousel. It shows the locking detents on the flanges, used to hold the unit in place in a display case.
Figure 3:
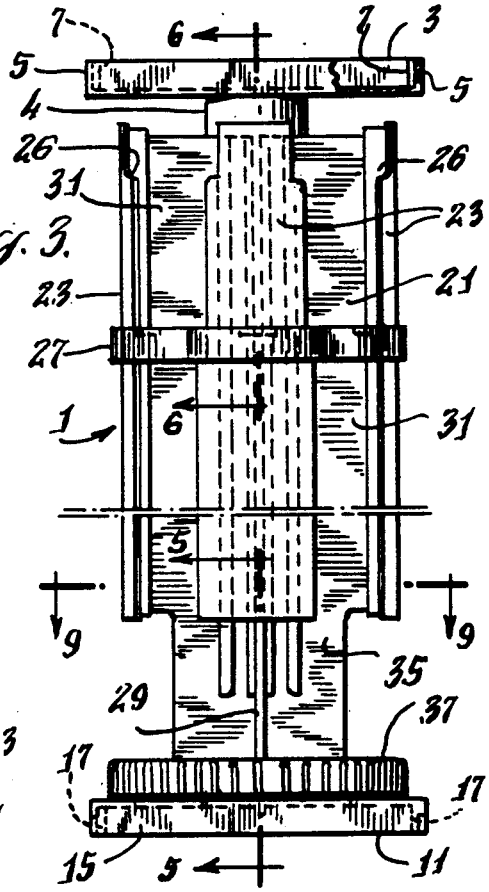
FIG. 3 is a front elevation of the carousel.
Figure 5:
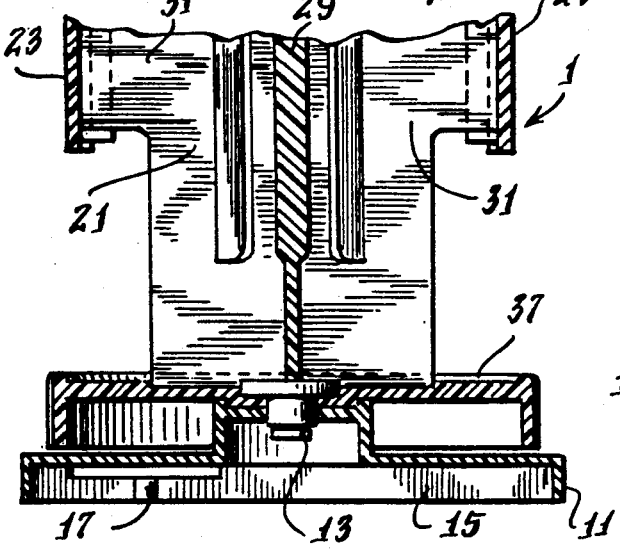
FIG. 5 is a vertical section taken on line 5—5 of FIG. 3.
Figure 4:
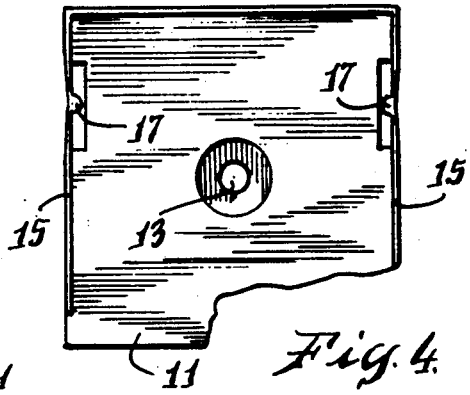
FIG. 4 is a bottom plan view of the bottom plate of the carousel. It shows the locking detents on the flanges, used to hold the unit in place in a display case or on a turntable.
Figure 10:
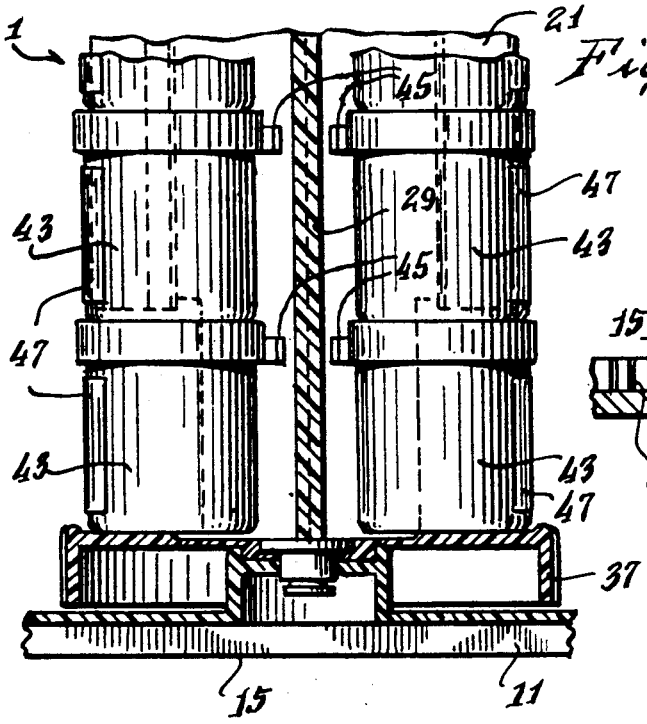
FIG. 10 is a vertical section taken on line 10—10 of FIG. 9.
Figure 13:
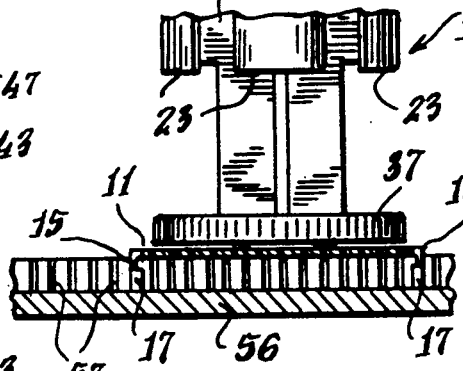
FIG. 13 is a vertical section taken on line 13—13 of FIG. 12.
Figure 12:
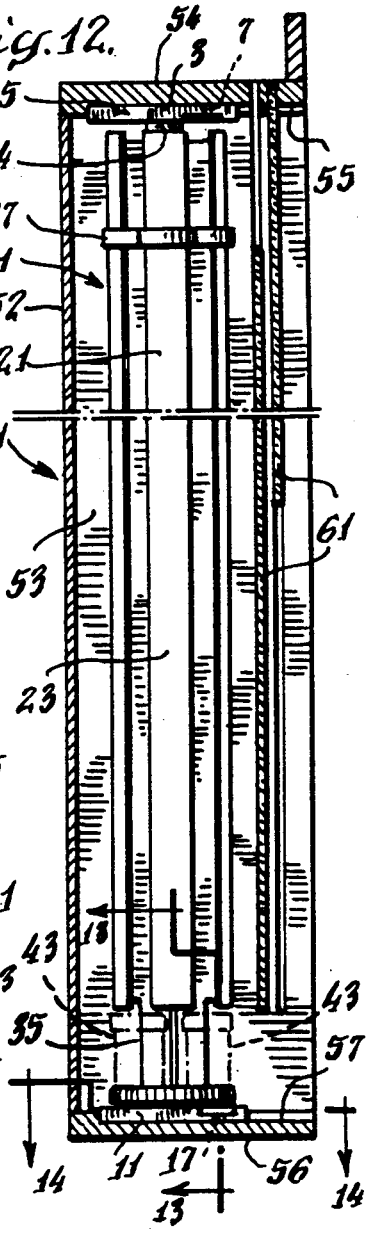
FIG. 12 is a vertical section running front to back of a display case showing the carousel mounted in the display case.
Figure 11:
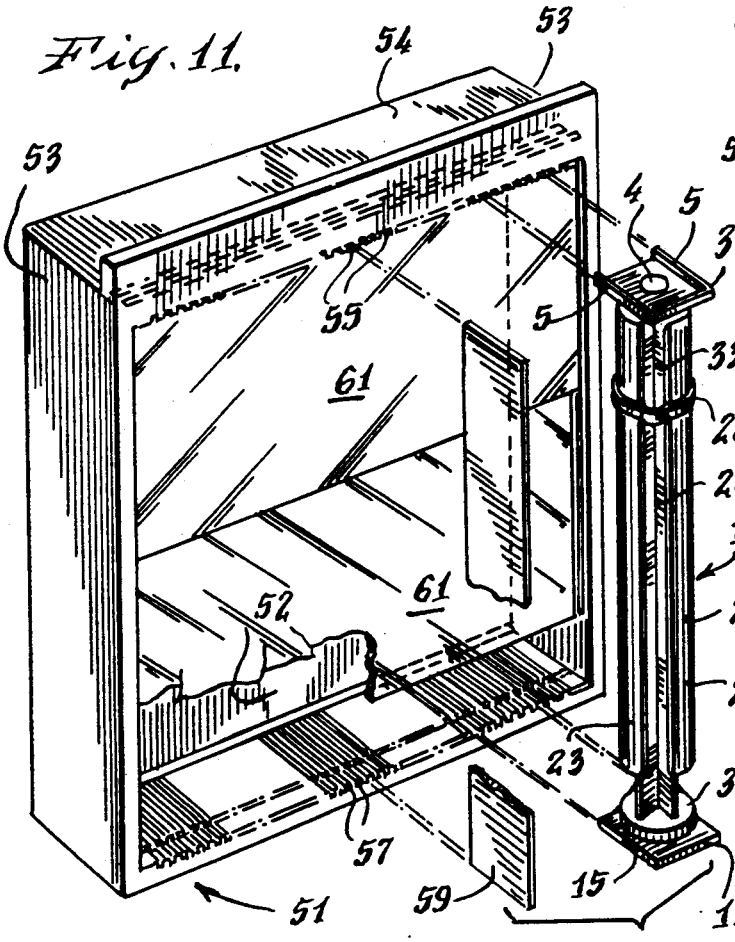
FIG. 11 is an exploded perspective view of a film display and dispensing unit with a carousel and dividers.

My film dispenser is formed as a rotating carousel 1. The body 21 of carousel 1 has a film carrying base 37 with a vertical spine 29 rising from the center of the base 37. Spine 29 carries four spaced, vertical dividers 31, and each divider carries a vertical outer wall 23. The spine, walls, and dividers form four channels 28 dimensioned to hold a stack of round film canisters 43. Vertical slots 25 run between adjacent walls 23, and are wide enough to enable a label 47 on a canister 43 to be seen, but narrow enough so the canisters are held within the channels. The slots are wider at the top 26 so that film canisters can be inserted into openings 33; and the walls 23 do not run all the way to the film-holding base 37, thus providing an opening 37 for removing film as it is dispensed. A collar 27 is fitted about the walls 23 just below the top opening 33 to assist in the loading of film.

The film canisters are round but have a protruding key 45 (FIG. 8) on one side of their caps (the side opposite the label) so that they can be aligned within the channels. Each channel has a key slot 32 adjacent the spine 29, shaped and dimensioned for complementary fit with the keys 45. Thus, the canisters are carried by the carousel in a position such that their labels can be seen through the slots 25.

The top of spine 29 of the carousel is pivoted to a top plate 3 at pivot 4; and the base 37 is pivoted to bottom plate 11 at pivot 13. The top plate has upwardly-extending side flanges 5, each of which has a locking detent 7 to hold the plate in place in a display cabinet. Bottom plate 11 similarly has downwardly-extending side flanges 15 with locking detents 17.

The carousel is dimensioned to fit vertically within the type of display cabinet 51 currently used with dividers 59 to provide compartments for boxes of film. Display cabinet 51 includes back panel 52, end walls 53, top 54 and bottom 56. The inside of the top 54 has a series of alternating ribs and grooves 55 running from front to back, the ribs having places to lockingly receive detents 7. The inside of the bottom 56 has a corresponding series of ribs and grooves 57 running from back to front, also with places to receive detents 17. The top and bottom plates 3 and 11 of the carousel, with their respective side flanges 5 and 15, are dimensioned to fit within the top and bottom grooves 55 and 57 with their detents 7 and 17 serving to lock them in place.

Normally, the cabinet will have sheets of glass or transparent plastic 61 forming a face panel. The sheets slide in channels in end walls 53, but the lower sheet does not go to the bottom of the cabinet, leaving space for removing film.

As can be seen, the display cabinet 51 can now be used to hold one or more carousels, and, at the same time, dividers 59 can be used in the remaining space to form compartments to hold boxes of film.

In use, the carousel is first installed in a display cabinet and the four channels filled with film canisters, usually a different type of film in each channel. When a roll of film is desired, the carousel is rotated so that the desired film is in front, and a canister removed from the bottom of that channel.

A modification of my invention is shown in FIGS. 15 to 17. Here, four carousels 1 are mounted in a free-standing turntable 71, and the display cabinet 51 is not used. Turntable 71 has base 73 with a pivoted carrier 75 mounted on it, carried by pivot 76. A rising support member 79 is positioned axially of carrier 75 and carries a top support 81. The upper surface of carrier 75 has four pairs of slots 77, with detent receiving places similar to those of display cabinet 51, to receive and hold the flanges 15 and detents 17 of bottom plates 11; and the lower surface of top support 81 has four corresponding pairs of slots 83, with similar detent receiving places, to receive and hold the flanges 5 and detents 7 of top plates 3.

Thus, it can be seen that the same carousel 1 can be used either with a display cabinet 51 or separately in association with a turntable 71.

I claim:

1. A carousel for dispensing canisters of film, said carousel including a film-holding base secured to a vertical spine mounted centrally of said base, a plurality of vertical channels formed about said spine and proximate to one another, said channels having vertical slots therein narrower than said canisters, said slots being on that portion of said channels farthest removed from said spine, the uppermost portions of said slots being widened and so dimensioned as to form openings to receive said canisters, and the lowermost ends of said channels having openings to permit removal of individual canisters, and means associated with said base and with the upper end of said spine for pivotally securing said carousel to a display device, said last-named means including a bottom plate pivotally secured to said base and a top plate pivotally secured to said upper end of said spine.

2. A carousel as set forth in claim 1 including a display device having inner top and bottom surfaces with grooves therein and in which said bottom plate has downwardly extending side flanges and said top plate has upwardly extending side flanges, and said top and bottom flanges complement said grooves, whereby said flanges can be fitted into said grooves.

3. A carousel for dispensing canisters of film, said carousel including a film-holding base secured to a vertical spine mounted centrally of said base, a plurality of vertical dividers extending radially from said spine, vertically-extending wall sections secured to the outermost edges of said dividers, said spine, said dividers, and said wall sections together forming vertical channels to receive and hold said canisters, the uppermost portions of said wall sections being so dimensioned as to form openings to receive said canisters, and the lowermost ends of said wall sections being spaced from said base sufficiently to permit removal of individual canisters, and means associated with said base and with the upper end of said spine for pivotally securing same to a display device, said last-named means including a bottom plate pivotally secured to said base and a top plate pivotally secured to said upper end of said spine.

4. A carousel as set forth in claim 3 including a display device having inner top and bottom surfaces with grooves therein and in which said bottom plate has downwardly extending side flanges and said top plate has upwardly extending side flanges, and said top and bottom flanges complement said grooves, whereby said flanges can be fitted into said grooves.

5. A carousel for dispensing canisters of film, said carousel including a bottom plate a film-holding base secured to a vertical spine mounted centrally of said base, a plurality of vertical dividers extending radially from said spine, vertically-extending wall sections secured to the outermost edges of said dividers, said spine, said dividers, and said wall sections together forming vertical channels to receive and hold said canisters, the uppermost portions of said wall sections being so dimensioned as to form openings to receive said canisters, and the lowermost ends of said wall sections being spaced from said base sufficiently to permit removal of individual canisters, said bottom plate being pivotally secured to the lower end of said spine, a top plate pivotally secured to the upper end of said spine, and means associated with said top and bottom plates for securing said plates to a display device.

6. A carousel as set forth in claim 5 in which said means for securing said plates are side flanges extending below said bottom plate and above said top plate, whereby said flanges can be interengaged with corresponding grooves on a display device.

7. A carousel as set forth in claim 6 including locking detents on said flanges.

* * * * *